US012127723B2

(12) United States Patent
Al-Shorachi et al.

(10) Patent No.: US 12,127,723 B2
(45) Date of Patent: Oct. 29, 2024

(54) VACUUM CLEANER UTENSIL

(71) Applicant: KONINKLIJKE PHILIPS N.V., Eindhoven (NL)

(72) Inventors: Albert Al-Shorachi, Zwolle (NL); Bastian Cornelis Kleine-Doepke, Zuidhorn (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 758 days.

(21) Appl. No.: 17/267,056

(22) PCT Filed: Aug. 20, 2019

(86) PCT No.: PCT/EP2019/072193
§ 371 (c)(1),
(2) Date: Feb. 9, 2021

(87) PCT Pub. No.: WO2020/043537
PCT Pub. Date: Mar. 5, 2020

(65) Prior Publication Data

US 2021/0290014 A1 Sep. 23, 2021

(30) Foreign Application Priority Data

Aug. 31, 2018 (EP) ..... 18192041

(51) Int. Cl.
*A47L 9/06* (2006.01)
*A47L 7/00* (2006.01)

(52) U.S. Cl.
CPC ..... *A47L 9/0613* (2013.01); *A47L 7/0066* (2013.01)

(58) Field of Classification Search
CPC ..... A47L 9/0613; A47L 7/0066
See application file for complete search history.

(56) References Cited

U.S. PATENT DOCUMENTS

2013/0174374 A1 7/2013 Guder
2017/0007086 A1 1/2017 Kleine-Deopke
2017/0049283 A1 2/2017 Sorrig

FOREIGN PATENT DOCUMENTS

CN 101610705 A 12/2009
CN 102014721 A 4/2011
(Continued)

OTHER PUBLICATIONS

International Search Report and Written Opinion Dated Oct. 4, 2019 for International Application No. PCT/EP2019/072193 Filed Aug. 20, 2019.

*Primary Examiner* — David Redding
(74) *Attorney, Agent, or Firm* — Maschoff Brennan

(57) ABSTRACT

In a vacuum cleaner utensil (1) comprising a suction opening (3) and a lint picker (5) at a side of the suction opening (3), the lint picker (5) is mounted in a recessed portion having a plurality of rims (7*a*-7*d*) along lines at an angle between 20° and 70° to a longitudinal axis (A-A) of the suction opening (3) that form edges pointing towards the suction opening (3). Preferably, the lint picker has a plurality of triangular-shaped elements (5*a*-5*d*). Preferably, the lint picker has a plurality of elements (5*a*-5*d*) that have first and second boundaries along lines at an angle between 20° and 70° to the longitudinal axis (A-A) of the suction opening (3), an angle between the first and second boundaries not exceeding 120°. Another aspect of the invention provides a vacuum cleaner comprising a suction unit, and a nozzle arranged for being coupled to the suction unit, wherein the nozzle is formed by such a vacuum cleaner utensil (1).

4 Claims, 1 Drawing Sheet

(56) References Cited

FOREIGN PATENT DOCUMENTS

| | | | |
|---|---|---|---|
| CN | 102599856 | A | 7/2012 |
| CN | 107743370 | A | 2/2018 |
| DE | 102008021353 | | 11/2009 |
| DE | 102012010075 | | 9/2013 |
| DE | 102014012347 | B3 | 11/2015 |
| EP | 3136935 | | 3/2017 |
| WO | 0226097 | | 4/2002 |
| WO | 2008111891 | | 9/2008 |

VACUUM CLEANER UTENSIL

CROSS REFERENCE TO RELATED APPLICATIONS

This application is the U.S. National Phase application under 35 U.S.C. § 371 of International Application No. PCT/EP2019/072193 filed Aug. 20, 2019, which claims the benefit of European Patent Application Number 18192041.4 filed Aug. 31, 2018. These applications are hereby incorporated by reference herein.

FIELD OF THE INVENTION

The invention relates to a vacuum cleaner utensil, i.e. to a vacuum cleaner nozzle in case of a vacuum cleaner having a separate nozzle, or to a robot vacuum cleaner which has an integrated nozzle. The invention also relates to a vacuum cleaner provided with a vacuum cleaner nozzle.

BACKGROUND OF THE INVENTION

WO0226097 discloses a floor tool for use in vacuum cleaning floor surfaces comprises a sole plate having a suction channel. The suction channel is bounded on at least one side by a working edge for engaging with the floor surface. Lint pickers are positioned alongside the suction channel and are separated from the suction channel by the working edge. The lint pickers are mounted on a surface of the floor tool which is inclined with respect to the plane in which the working edges lie. A lint picker is a strip of material into which a plurality of tufts of fine hair are secured. All of the tufts are aligned in the same direction with respect to the sole plate. The lint picker acts as a one-way gate, allowing lint to pass under the lint picker when the floor tool is pushed along the floor, but to block the lint when the floor tool is pulled backwards. The repeated forward and backwards action of the floor tool across the floor surface traps the lint and rolls it into a ball such that it can be sucked by the floor tool. Each lint picker is mounted within a recessed portion of the sole plate. However, the pick-up performance of such tools is limited.

DE102012010075 discloses a floor cleaning element (e.g. a floor nozzle), for use in vacuum cleaner. The element has a front brush strip comprising diagonal bristles whose free ends are oriented towards the middle of a receiving opening, and a rear brush strip that is narrower than the front brush strip in direction transverse to a rear edge and/or a front edge. Front and rear suction channels are provided between the front and rear edges and the front and rear brush strips, respectively. The front and rear suction channels respectively extend along the front and rear edges and air flow-conductively connected with the receiving opening.

SUMMARY OF THE INVENTION

It is, inter alia, an object of the invention to provide an improved vacuum cleaner utensil. The invention is defined by the independent claims. Advantageous embodiments are defined in the dependent claims.

One aspect of the invention provides a vacuum cleaner utensil, comprising a suction opening, and a lint picker at a side of the suction opening, wherein the lint picker is mounted in a recessed portion having a plurality of rims along lines at an angle between 20° and 70° to a longitudinal axis of the suction opening that form edges pointing towards the suction opening. Preferably, the lint picker has a plurality of triangular-shaped elements. Preferably, the lint picker has a plurality of elements that have first and second boundaries along lines at an angle between 20° and 70° to a longitudinal axis of the suction opening, an angle between the first and second boundaries not exceeding 120°.

Without wishing to be bound by theory, one reason for a les optimal performance of prior art tools may be that coarse dirt particles get stuck at a rim of a recessed portion of the sole plate in which the lint picker is mounted. If the recessed portion has a plurality of rims along lines at an angle between 20° and 70° to a longitudinal axis of the suction opening that form edges pointing towards the suction opening, coarse dirt particles can easier escape from behind the rims, e.g. because of the shape of the pointed elements, coarse dirt particles are gathered in the points close to the suction opening, so that other coarse dirt particles may push a coarse dirt particle over the rim so that it can be sucked up at the suction opening.

Another aspect of the invention provides a vacuum cleaner comprising a suction unit, and a nozzle arranged for being coupled to the suction unit, wherein the nozzle is formed by such a vacuum cleaner utensil.

These and other aspects of the invention will be apparent from and elucidated with reference to the embodiments described hereinafter.

DESCRIPTION OF EMBODIMENTS

Figure 1:
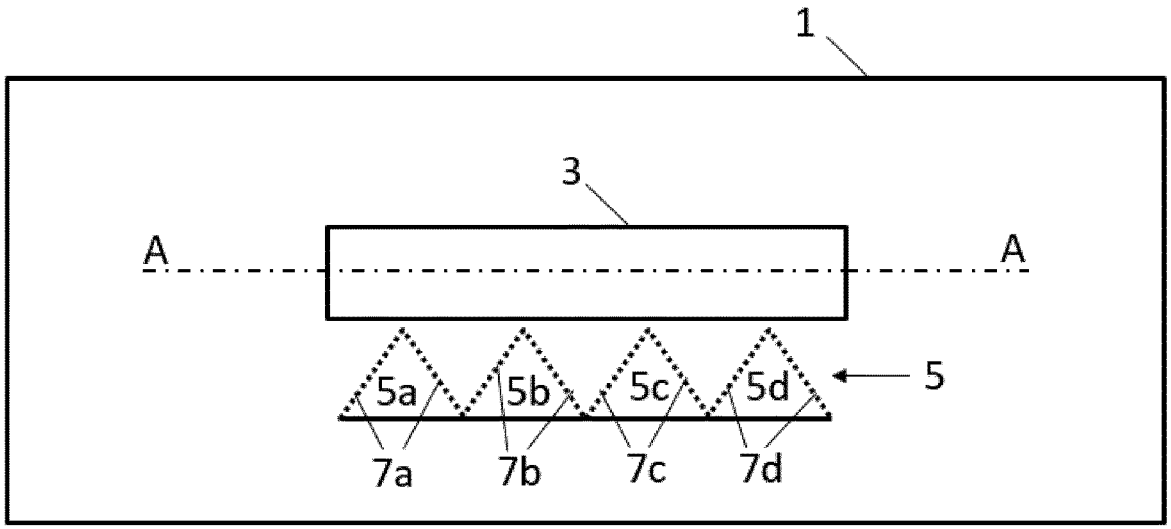
FIGS. 1 and 2 illustrate embodiments of a vacuum cleaner utensil in accordance with the invention.

FIG. 1 illustrates a bottom view of a vacuum cleaner utensil in accordance with a first embodiment of the invention. Only the essential elements are shown, other elements not relevant to this invention, like wheels and brushes, are left out. The vacuum cleaner utensil (e.g. a nozzle) 1 has a suction opening 3, and a lint picker 5 having plurality of triangular elements 5*a*-5*d* pointing towards the suction opening 3. In an embodiment, another, similar lint picker is placed at the opposite end of the suction opening 3. Each triangular elements 5*a*-5*d* is mounted in a respective recess having 3 rims, one of which (shown in a solid line) is parallel to the suction opening 3, and two of which (shown in dotted lines) with reference signs 7*a*-7*d* are oriented along lines at an angle between 20° and 70° to a longitudinal axis A-A of the suction opening 3, an angle between the first and second boundaries being 120°. The pairs of boundaries 7*a*-7*d* form edges pointing towards the suction opening 3.

Figure 2:
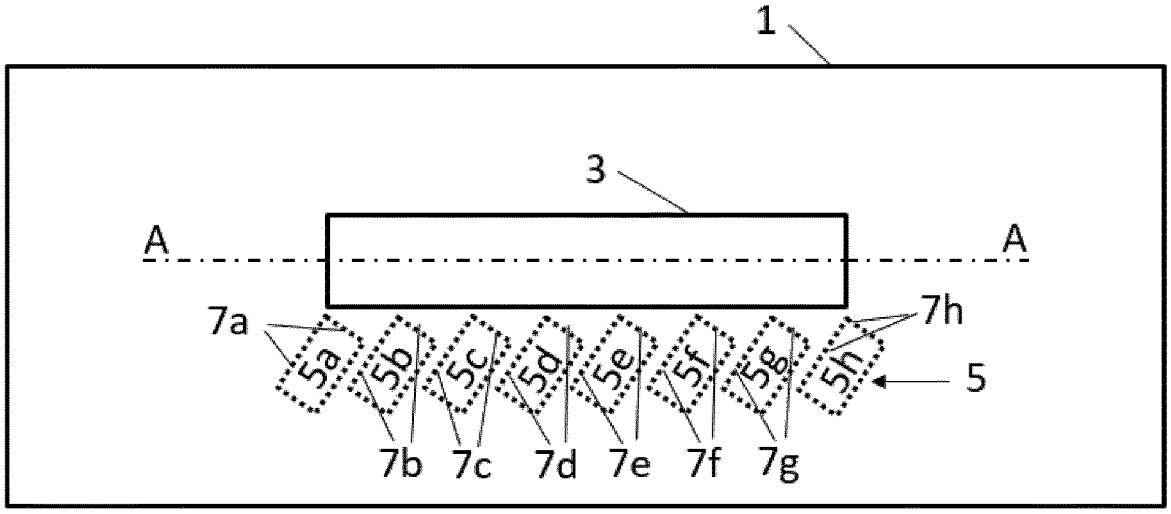

FIG. 2 illustrates a bottom view of a vacuum cleaner utensil in accordance with a second embodiment of the invention. Compared to FIG. 1, the lint picker 5 has plurality of rectangular elements 5*a*-5*h* pointing towards the suction opening 3. Here, the recessed portion is formed by a plurality of recessed portions, each housing a respective one of the rectangular elements 5*a*-5*h*. Each rectangular element 5*a*-5*h* is housed in a respective recessed portion that has pairs of two rims 7*a*-7*h* (out of the four rims shown in dotted lines) that meet each other close to the suction opening 3, thereby forming edges pointed towards the suction opening 3. These rims 7*a*-7*h* are oriented along lines at an angle between 20° and 70° to a longitudinal axis A-A of the suction opening 3. An angle between the rims of each pair of rims 7*a*-7*h* is 90°. In an alternative embodiment, the rectangular elements 5*a*-5*h* do not have spaces between them, and then there may be a single recessed portion housing the lint picker 5. Also, the elements 5*a*-5*h* may have a straight lower boundary parallel to the lower boundary of the vacuum cleaner utensil 1 (like in FIG. 1), and then the recessed portion or portions housing the elements 5*a*-5*h* may likewise have a straight lower boundary parallel to the lower boundary of the vacuum cleaner utensil 1.

It should be noted that the above-mentioned embodiments illustrate rather than limit the invention, and that those skilled in the art will be able to design many alternative embodiments without departing from the scope of the appended claims. For example, the lint pickers 5 may be mounted in inclined portions of the sole plate of the nozzle 1, and the lint picker 5 does not need to be immediately adjacent to the suction opening 3. For example, there may be a flat portion of the nozzle's sole plate directly adjacent to the suction opening 3, while the lint picker 5 is present on an inclined portion of the sole plate adjacent to that flat portion. The elements of the lint picker 5 do not need to be distinct elements; they may overlap and/or have a common base as long as parts point towards the suction opening 3. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements. In the device claim enumerating several means, several of these means may be embodied by one and the same item of hardware. Measures recited in mutually different dependent claims may advantageously be used in combination.

The invention claimed is:

1. A vacuum cleaner utensil, comprising:

a suction opening;

a lint picker at a side of the suction opening, wherein the lint picker is mounted in a recessed portion, wherein the recessed portion has at least two rims from a plurality of rims oriented along lines at an angle between 20° and 70° to a longitudinal axis of the suction opening, and meet each other to form edges pointing towards the suction opening.

2. The vacuum cleaner utensil as claimed in claim 1, wherein the lint picker has a plurality of triangular-shaped elements.

3. The vacuum cleaner utensil as claimed in claim 1, wherein the lint picker has a plurality of elements that have first and second boundaries along lines at an angle between 20° and 70° to the longitudinal axis of the suction opening, an angle between the first and second boundaries not exceeding 120°.

4. A vacuum cleaner comprising:

a suction unit, and a nozzle arranged for being coupled to the suction unit, wherein the nozzle is formed by a vacuum cleaner utensil as claimed in claim 1.

* * * * *